US012421754B2

(12) United States Patent
Frazier et al.

(10) Patent No.: US 12,421,754 B2
(45) Date of Patent: Sep. 23, 2025

(54) NET SECURING SYSTEM, APPARATUS, AND METHODS

(71) Applicant: Soccer Park, LLC, Boise, ID (US)

(72) Inventors: Joshua Leland Frazier, Boise, ID (US); Justin Shook, Boise, ID (US)

(73) Assignee: SOCCER PARK, LLC, Boise, ID (US)

( * ) Notice: Subject to any disclaimer, the term of this patent is extended or adjusted under 35 U.S.C. 154(b) by 457 days.

(21) Appl. No.: 18/045,197

(22) Filed: Oct. 10, 2022

(65) Prior Publication Data

US 2024/0117652 A1 Apr. 11, 2024

(51) Int. Cl.
*E04H 17/06* (2006.01)
*A63B 71/02* (2006.01)

(52) U.S. Cl.
CPC ..... *E04H 17/06* (2013.01); *A63B 71/022* (2013.01)

(58) Field of Classification Search
CPC ..... E04H 17/003; E04H 17/02; E04H 17/05; E04H 17/06; E04H 17/08; E04H 17/10; E04H 17/12; E04H 17/124; E04H 17/16; E04H 17/161; E04H 17/165; E04H 17/168; E04H 17/24; A63B 71/022; A63B 71/023; A63B 63/004; A63B 2063/005; A63C 2019/085
USPC ..... 256/11
See application file for complete search history.

(56) References Cited

U.S. PATENT DOCUMENTS

| | | | | | |
|---|---|---|---|---|---|
| 1,237,601 | A * | 8/1917 | Arthur | E04H 17/24 | 256/3 |
| 2,221,477 | A * | 11/1940 | Gustafson | E04H 17/124 | 248/230.8 |
| 3,363,389 | A * | 1/1968 | Montgomery | E04H 17/163 | 52/656.8 |
| 5,155,963 | A * | 10/1992 | Woodman | E04C 2/42 | 160/351 |
| 6,004,218 | A * | 12/1999 | Keating | A63C 19/10 | 472/94 |
| 9,056,232 | B2 * | 6/2015 | Rigoli | A63B 63/004 | |
| 11,701,562 | B2 * | 7/2023 | Kapsalis | A63B 63/004 | 473/446 |
| 2014/0138595 | A1 * | 5/2014 | Tarkington, Jr. | E04H 17/003 | 256/59 |
| 2022/0088458 | A1 * | 3/2022 | Hutt | A63B 71/022 | |

* cited by examiner

*Primary Examiner* — Jonathan P Masinick
(74) *Attorney, Agent, or Firm* — Parsons Behle & Latimer

(57) ABSTRACT

Apparatus, systems, and methods for securing a net. The system includes a wall cap having an upper cavity and a lower cavity and a gap that provides access to the upper cavity. A wall is positioned within the lower cavity. A portion of a net is positioned within the upper cavity of the wall cap. A rod positioned within the upper cavity of the wall cap is intertwined through the portion of the net positioned within the upper cavity of the wall cap. The rod may have an outer diameter that prevents the rod from moving through the gap in the wall cap. A cable is wrapped around the rod along the length of the wall cap. Portions of the cable are positioned above the rod along its length and portions of the cable are positioned through the wall and the wall cab below the rod.

9 Claims, 6 Drawing Sheets

NET SECURING SYSTEM, APPARATUS, AND METHODS

FIELD OF THE DISCLOSURE

The embodiments described herein relate to apparatuses, systems, and methods for securing a net to a wall of a sports field.

BACKGROUND

Description of the Related Art

It may be desired to have local sporting fields to permit individuals to exercise, engage in sporting contests, and/or engage in various outdoor activities. Sporting fields often may use a net around the field to keep the playing ball within the field. Past designs often secured the net by pinching portions of the net between wall portions. The pinching mechanism used to secure the net created weak points in the net, which over time may break when a ball or other object impacts the net in an area adjacent to one of the weak points. Other disadvantages may exist.

SUMMARY

The present disclosure is directed to net securing apparatus, systems, and methods.

One embodiment of the disclosure is an apparatus that includes a first member having a first length, the first member having a lower portion and an upper portion. The upper portion of the first member is curved. The apparatus includes a second member having the first length, the second member having a bottom portion, a top portion, and a curved end portion attached to the top portion. The curved end portion extends towards the first member. The upper portion of the first member extends towards the second member. The apparatus includes a cross member having the first length, the cross member extending between the first member and the second member.

The apparatus includes an upper cavity. The upper cavity is defined by the upper portion of the first member, the top and curved end portions of the second member, and the cross member. The apparatus includes a lower cavity between the lower portion of the first member the bottom portion of the second member. The apparatus includes a lower opening that provides access to the lower cavity. The apparatus includes a gap having a distance. The gap is positioned between an end of the upper portion of the first member and an end of the curved end portion of the second member. The gap provides access to the upper cavity.

The apparatus includes a first plurality of apertures through the upper portion of the first member. The apparatus includes a second plurality of apertures through the top portion of the second member. The apparatus includes a third plurality of apertures through the lower portion of the first member. The apparatus includes a fourth plurality of apertures through the bottom portion of the second member.

The apparatus may include a rod positioned within the upper cavity. The rod may have a diameter that is larger than the distance of the gap. The rod may be comprised of nylon. Each of the first plurality of apertures may be axially aligned with a respective aperture of the second plurality of apertures. Each of the third plurality of apertures may be axially aligned with a respective aperture of the fourth plurality of apertures. The apparatus may include a first internal shoulder positioned within the lower cavity and a second internal shoulder positioned within the lower cavity. The first internal shoulder may extend from the lower portion of the first member and the second internal shoulder may extend from the bottom portion of the second member.

One embodiment of the present disclosure is a system for securing a net. The system includes a wall cap having a length. The wall cap includes an upper cavity and a lower cavity. The wall cap includes a gap that provides access to the upper cavity and a lower opening that provides access to the lower cavity. The system includes a wall. A portion of the wall is positioned within the lower cavity of the wall cap. The wall cap is connected to the wall. The system includes a net. A portion of the net is positioned within the upper cavity of the wall cap. The system includes a rod positioned within the upper cavity of the wall cap. The rod is intertwined through the portion of the net positioned within the upper cavity of the wall cap. The system includes a cable. The cable is wrapped around the rod along the length of the wall cap.

The rod of the system may have an outer diameter that is larger than a distance of the gap that provides access to the upper cavity. The cable may be positioned through a first plurality of apertures and second plurality of apertures in the wall cap. The first and second plurality of apertures may be positioned through the wall cap axially above the rod. The cable may be positioned through a third plurality of apertures and a fourth plurality of apertures in the wall cap. The third and fourth plurality of apertures may be positioned through the wall cap axially below the rod. The cable may be positioned through a fifth plurality of apertures through the wall. The fifth plurality of apertures may be axially aligned with both the third and fourth plurality of apertures through the wall cap.

The system may include a first obstruction located at a first end of the cable. The first obstruction may prevent the first end of the cable from passing through the first, second, third, fourth, or fifth plurality of apertures. The system may include a second obstruction located at a second end of the cable. The second obstruction may prevent the second end of the cable from passing through the first, second, third, fourth, or fifth plurality of apertures. The first and second obstructions may be a clamp. The wall cap of the system may include two internal shoulders within the lower cavity. An upper end of the wall may be positioned adjacent to the two internal shoulders.

One embodiment of the disclosure is a method for securing a net. The method comprises positioning a wall within a lower cavity of a wall cap and positioning a portion of a net within an upper cavity of the wall cap. The method includes inserting a rod into the upper cavity of the wall cap from an end of the wall cap and intertwining the rod through the net as the rod is inserted into the upper cavity of the wall cap. The method includes running a cable along a length of the wall cap. The cable is wrapped through the wall cap above the rod and wrapped through the wall cap and through the wall below the rod.

The method may include preventing a first end of the cable from moving through an aperture in the wall cap prior to running the cable along the length of the wall cap. The method may include preventing a second end of the cable from moving through an aperture in the wall cap after running the cable along the length of the wall cap.

Figure 1:
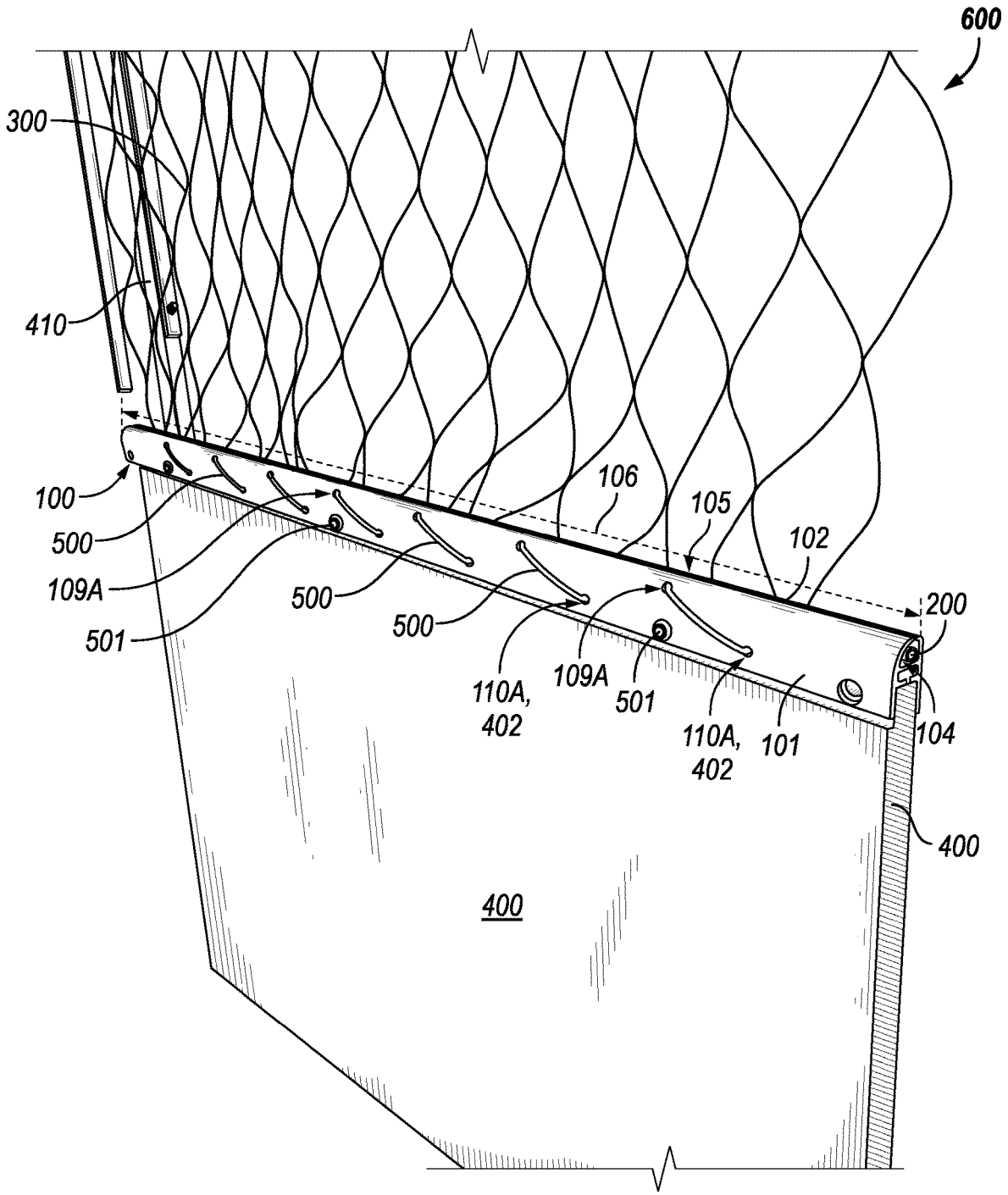
FIG. 1 shows a perspective view of an embodiment of a system of the disclosure.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows a perspective view of an embodiment of a system 600 for securing a net of the present disclosure. The system 600 includes a wall cap, also referred to herein as an apparatus, 100 having a length 106. The wall cap 100 includes an upper cavity 104 (best shown in FIGS. 2 and 3) and a lower cavity 107 (best shown in FIGS. 2 and 3). The wall cap 100 includes a gap 105 that provides access to the upper cavity 104 and a lower opening 108 (best shown in FIG. 3) that provides access to the lower cavity 107.

Figure 3:
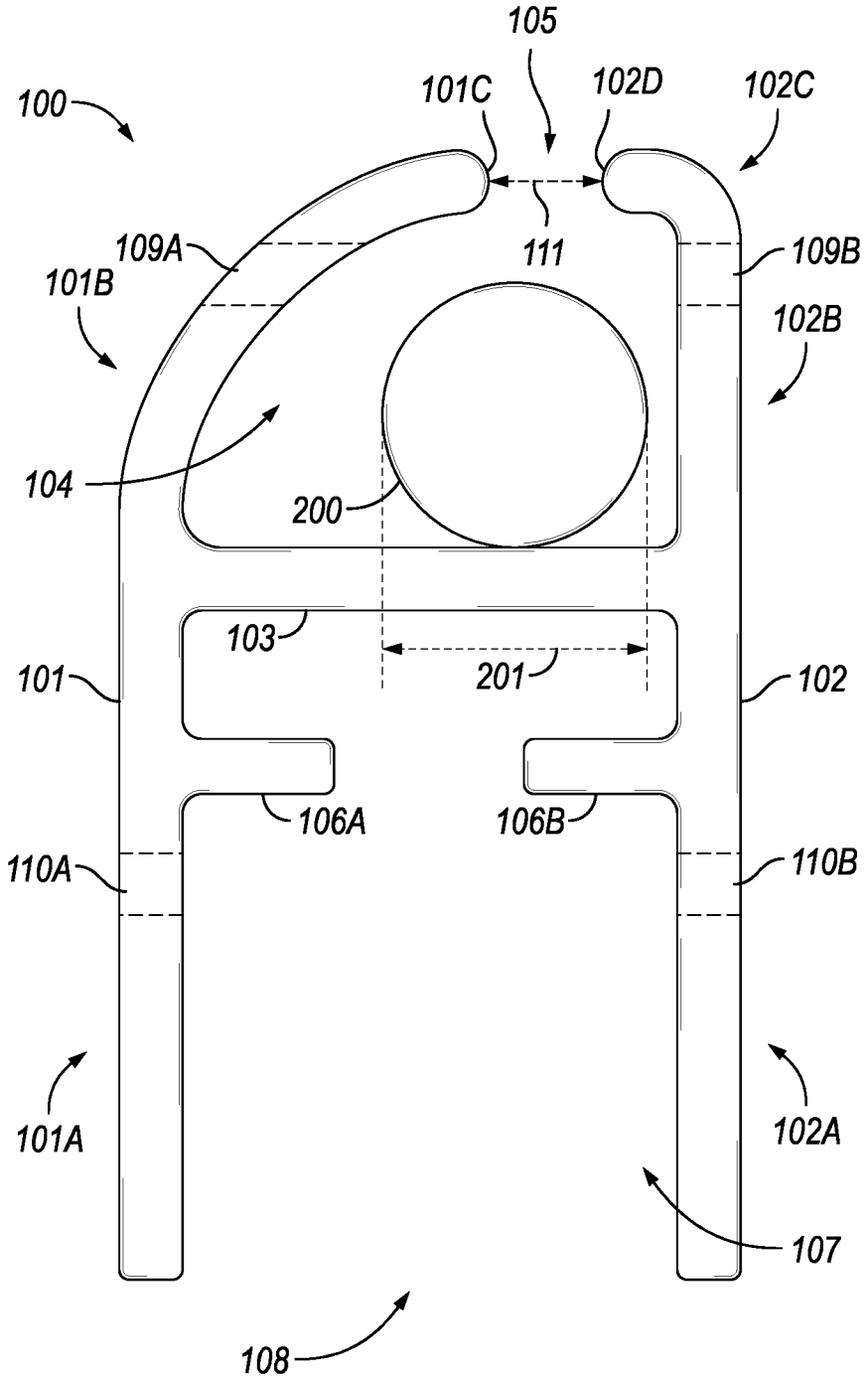
FIG. 3 is a cross-sectional view of an apparatus of the disclosure.

FIG. 3 is a cross-sectional view of an apparatus, also referred to herein as a wall cap, 100 of the present disclosure. The apparatus 100 includes a first member 101 having a first length 106. The first member 101 having a lower portion 101A and an upper portion 101B. The upper portion 101B of the first member 101 is curved. The apparatus 100 includes a second member 102 having the first length 106. The second member 102 having a bottom portion 102A, a top portion 102B, and a curved end portion 102C attached to the top portion 102B. The first member 101 may be a single member or may be components connected together to form the first member 101 as would be appreciated by one of ordinary skill in the art having the benefit of this disclosure. Likewise, the second member 102 may be a single member or may be components connected together to form the second member 102 as would be appreciated by one of ordinary skill in the art having the benefit of this disclosure.

The curved end portion 102C of the second member 102 extends towards the first member 101. Likewise, the upper portion 101B of the first member 101 extends towards the second member 102. The apparatus, or wall cap, 100 includes a cross member 103 also having the first length 106. The cross member 103 extends between the first member 101 and the second member 102.

The apparatus 100 includes an upper cavity 104. The upper cavity 104 is defined by the upper portion 101B of the first member 101, the top and curved end portions 102B, 102C of the second member 102, and the cross member 103. The apparatus 100 includes a lower cavity 107 between the lower portion 101A of the first member 101 the bottom portion 102A of the second member 102. The apparatus 100 includes a lower opening 108 that provides access to the lower cavity 107. The apparatus 100 includes a gap 105 having a distance 111. The gap 105 is positioned between an end 101C of the upper portion 101B of the first member 101 and an end 102D of the curved end portion 102C of the second member 102. The gap 105 provides access to the upper cavity 104.

The apparatus, or wall cap, 100 includes a first plurality of apertures 109A through the upper portion 101B of the first member 101. The apparatus 100 includes a second plurality of apertures 109B through the top portion 102B of the second member 102. The apparatus 100 includes a third plurality of apertures 110A through the lower portion 10A of the first member 101. The apparatus 100 includes a fourth plurality of apertures 110B through the bottom portion 102A of the second member 102.

The apparatus 100 may include a rod 200 positioned within the upper cavity 104. The rod 200 has a diameter 201 that is larger than the distance 111 of the gap 105. The rod 200 may be comprised of nylon, or the like. Each of the first plurality of apertures 109A are axially aligned with a respective aperture of the second plurality of apertures 109B. Each of the third plurality of apertures 110A are axially aligned with a respective aperture of the fourth plurality of apertures 110B. The apparatus 100 includes a first internal shoulder 106A positioned within the lower cavity 107 and a second internal shoulder 106B positioned within the lower cavity 107. The first internal shoulder 106A extends from the lower portion 101A of the first member 101 and the second internal shoulder 106B extends from the bottom portion 102A of the second member 102. The size, shape, number, and/or configuration of the various components of the wall cap 100 may be varied as would be appreciated by one of ordinary skill in the art having the benefit of this disclosure. For example, the location, number, and/or size of the apertures 109A, 109B, 110A, 110B may be varied as would be appreciated by one of ordinary skill in the art having the benefit of this disclosure.

Referring again to FIG. 1, the system 600 includes a wall 400. A portion of the wall 400 is positioned within the lower cavity 107 of the wall cap 100. The wall cap 100 is connected to the wall 400. The system includes a net 300. A portion of the net 300 is positioned within the upper cavity 104 of the wall cap 100. The system 600 includes a rod 200 positioned within the upper cavity 104 of the wall cap 100. The rod 200 is intertwined through the portion of the net 300 positioned within the upper cavity 104 of the wall cap 100. The use of the rod 200 intertwined through the net 300 causes the distribution of a load when an object impacts with the net 300 rather than a focused load at pinch points of the prior net securing systems. The system 600 includes a cable 500. The cable 500 is wrapped around the rod 200 along the length 106 of the wall cap 100.

Figure 2:
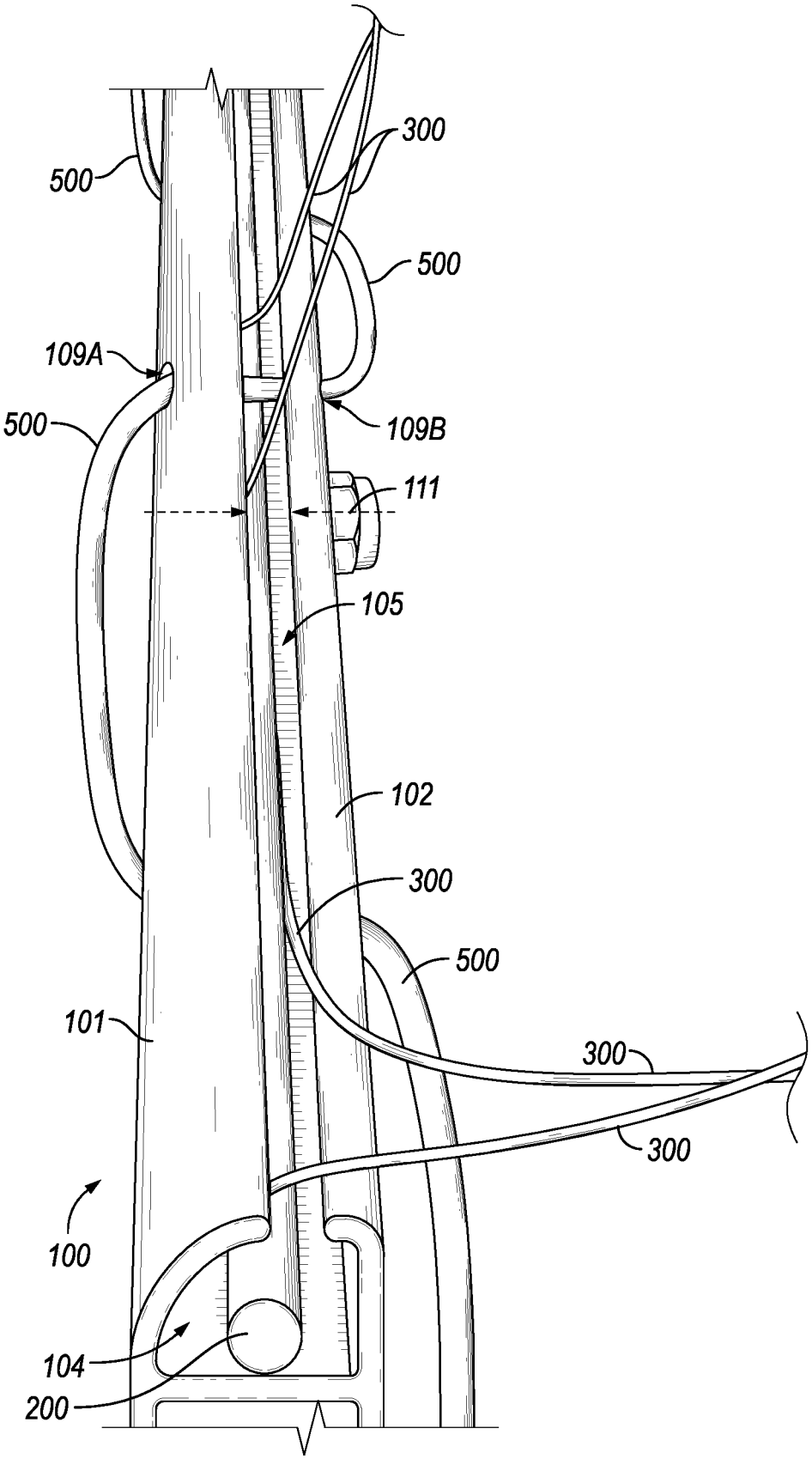
FIG. 2 shows a top perspective view of a portion of embodiment of a system of the disclosure.
Figure 4:
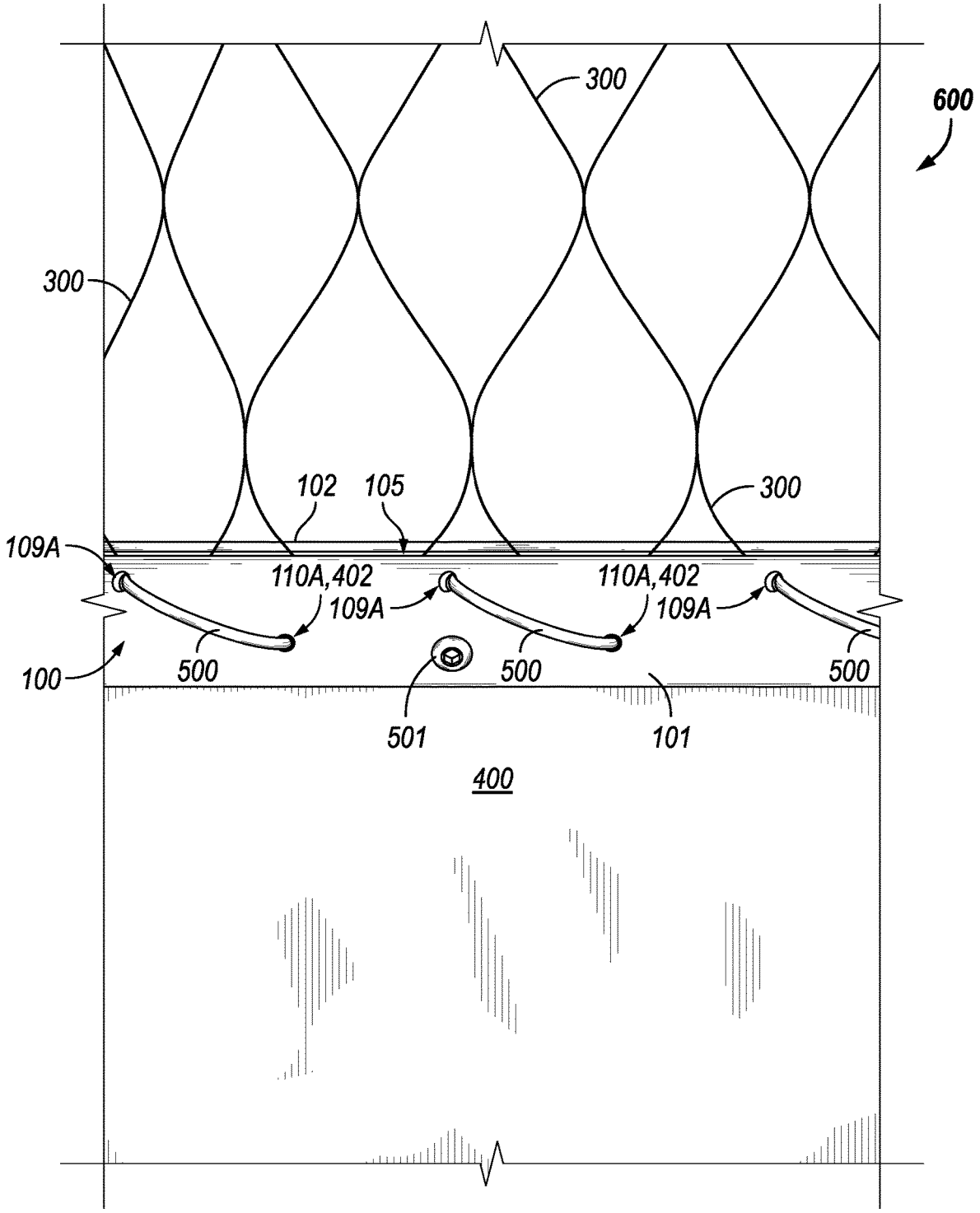
FIG. 4 is a perspective view of a portion of an embodiment of a system of the disclosure.

As discussed herein, the rod 200 of the system 600 has an outer diameter 201 that is larger than a distance 111 of the gap 105 that provides access to the upper cavity 104. This prevents the net 300 intertwined with the rod 200 from moving out of the upper cavity 104. In addition, the cable 500 wrapped both above and below the rod 200 secures the net 300 within the upper cavity 104 of the wall cap 100 as shown in FIGS. 2 and 4. The cable 500 passes above the rod 200 through apertures 109A, 109B in the wall cap 100. The cable 500 passes below the rod through apertures 110A, 110B in the wall cap 100. The cable 500 also passes through a portion of the wall 400 between apertures 110A, 100B of the wall cap 100 through apertures 402 in the wall 400.

The cable 500 is positioned through a first plurality of apertures 109A and second plurality of apertures 109B in the wall cap 100. The first and second plurality of apertures 109A, 109B are positioned through the wall cap 100 axially above the rod 200. The cable 500 is positioned through a third plurality of apertures 110A and a fourth plurality of apertures 110B in the wall cap 100. The third and fourth plurality of apertures 110A, 110B are positioned through the wall cap 100 axially below the rod 200. The cable 500 is positioned through a fifth plurality of apertures 402 through the wall 400. The fifth plurality of apertures 402 are axially aligned with both the third and fourth plurality of apertures 110A, 110B through the wall cap 100. Fasteners 501 may be used to secure the wall cap 100 to the wall 400. The net 300 may be connected to an upright 410 that is connected to the wall 400.

Figure 5:
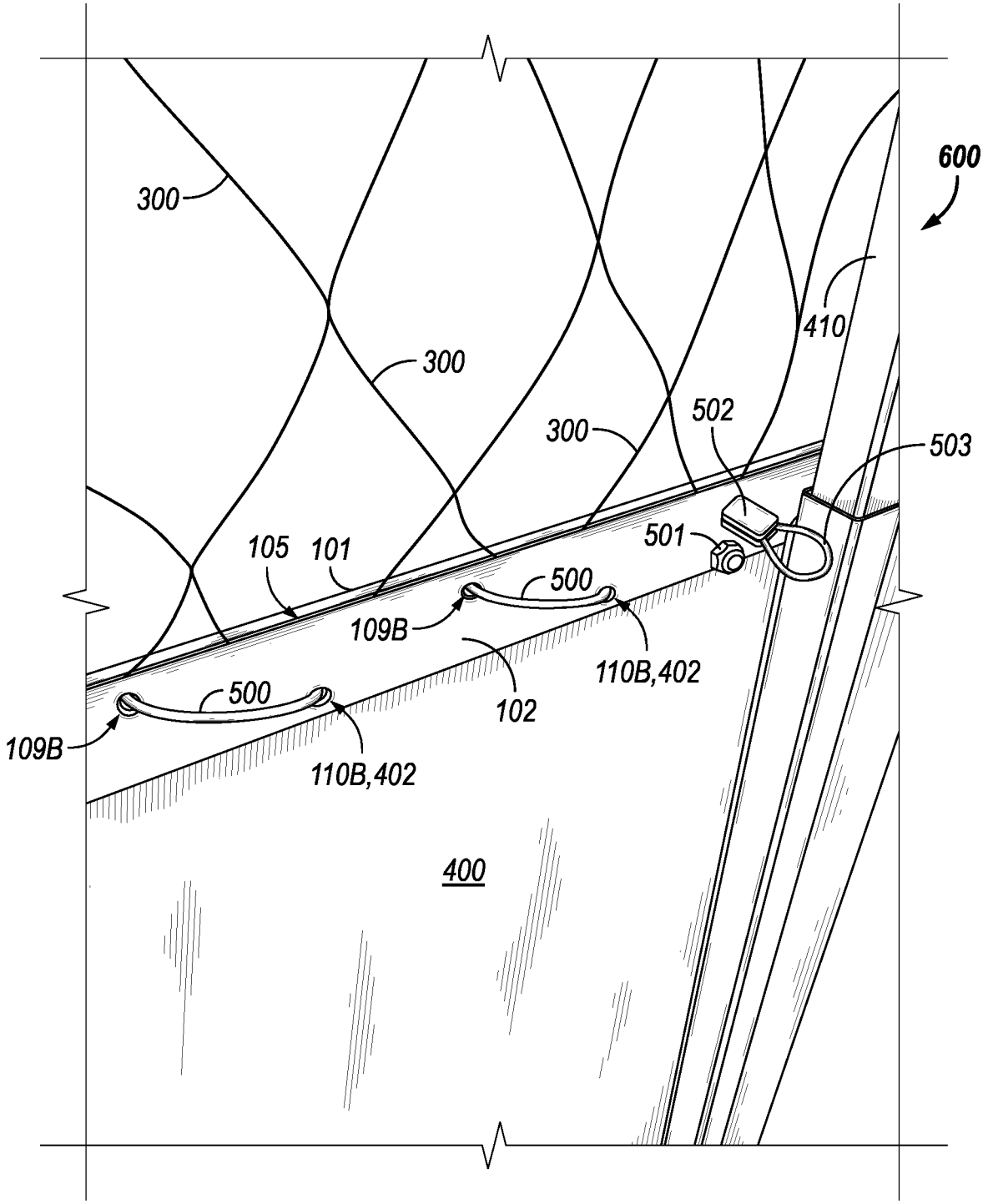
FIG. 5 is a perspective view of a portion of an embodiment of a system of the disclosure.

The system 600 includes a first obstruction 502 located at a first end of the cable 503 as shown in FIG. 5. The first obstruction 502 prevents the first end 503 of the cable from passing through the first, second, third, fourth, or fifth plurality of apertures 109A, 109B, 110A, 110B, 402. The system also includes a second obstruction (not shown) located at a second end of the cable 500. The second obstruction also prevent the second end of the cable 500 from passing through the first, second, third, fourth, or fifth plurality of apertures 109A, 109B, 110A, 110B, 402. The first and second obstructions may be a clamp. The wall cap 100 of the system 600 includes two internal shoulders 106A, 106B within the lower cavity 107 as shown in FIG. 3. An upper end of the wall 400 is positioned adjacent to the two internal shoulders 106A, 106B.

Figure 6:
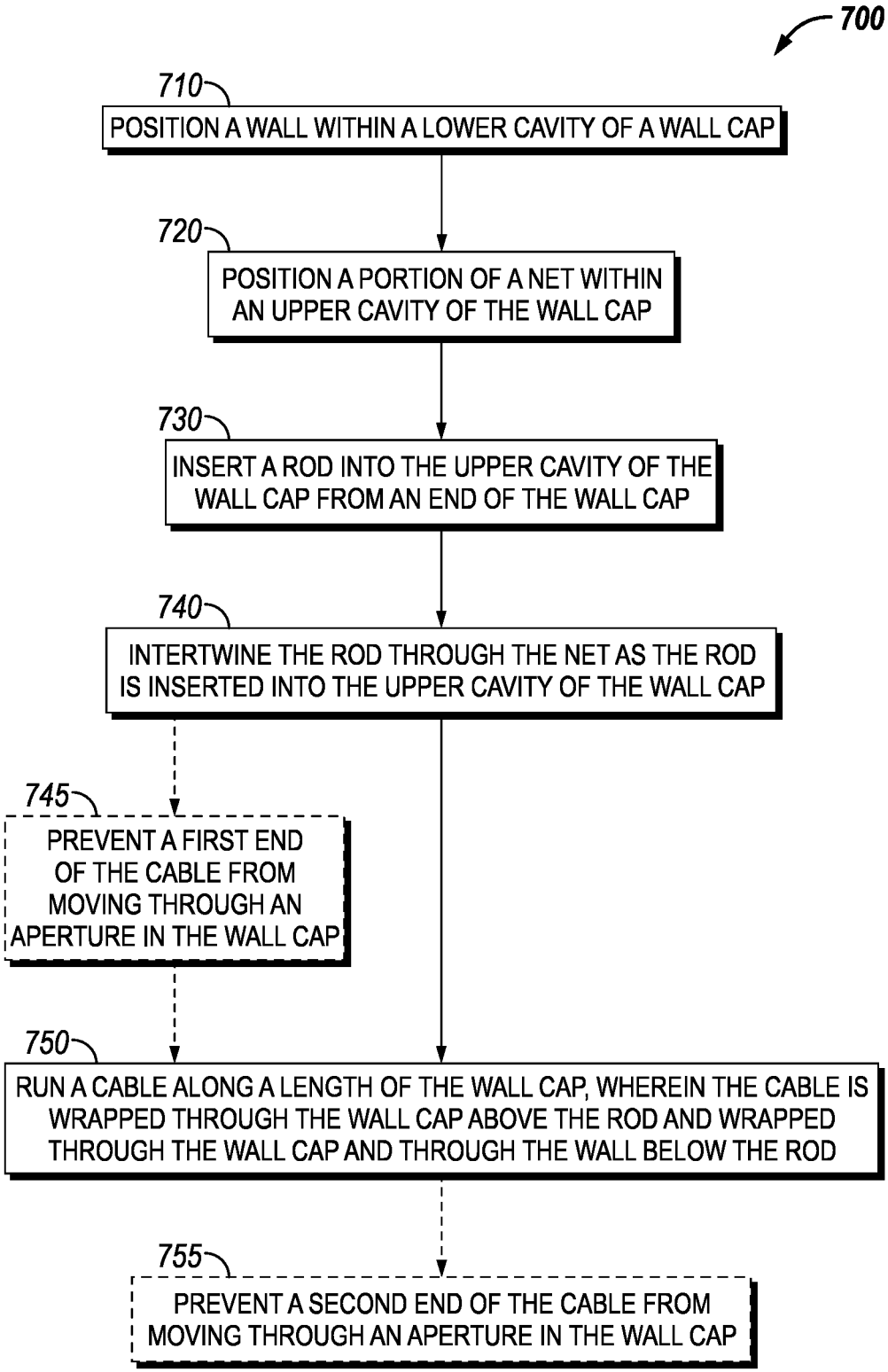
FIG. 6 is a flow chart of an embodiment of a method of the disclosure.

FIG. 6 is a flow chart for an embodiment of a method 700 for securing a net. The method 700 includes positioning a wall within a lower cavity of a wall cap, at 710. For example, a wall 400 may be positioned within the lower cavity 107 of a wall cap 100. The wall 400 may be positioned adjacent two internal shoulders 106A, 106B located within the lower cavity 107. The method 700 includes positioning a portion of a net within an upper cavity of the wall cap, at 720. For example, a portion of a net 300 may be positioned within the upper cavity 104 of a wall cap 100 that is connected to the wall 400.

The method 700 includes inserting a rod into the upper cavity of the wall cap from an end of the wall cap, at 730. For example, a rod 200 may be inserted into the upper cavity 104 of a wall cap 100 from either end of the wall cap 100. The method 700 includes intertwining the rod through the net as the rod is inserted into the upper cavity of the wall cap, at 740. For example, the rod 200 may be weaved through the portion of the net 300 positioned within the upper cavity 104 of the wall cap 100 to retain the net 300 within the upper cavity 104. This mechanism of connecting the net 300 to the wall 400 may help to distribute a load force when an object impacts the net 300, which may potentially decrease the chance a portion of the net 300 fails due to the impact of the object. The method 700 includes running a cable along a length of the wall cap, at 750. For example, the cable 500 is wrapped through the wall cap 100 above the rod 200 and wrapped through the wall cap 100 and through the wall 400 below the rod 200.

The method 700 may include preventing a first end of the cable from moving through an aperture in the wall cap prior to running the cable along the length of the wall cap, at 745. For example, an obstruction, such as a clamp 502, may be connected to the first end of the cable 500 to prevent the first end of the cable from passing through an aperture in the wall cap 100 and/or wall 400. The method 700 may include preventing a second end of the cable from moving through an aperture in the wall cap after running the cable along the length of the wall cap, at 755. For example, an obstruction, such as a clamp 502, may be connected to the second end of the cable 500 to prevent the second end of the cable from passing through an aperture in the wall cap 100 and/or wall 400 after the cable 500 has been run along the length of the wall cap 100 being wrapped both above and below the rod 200 as it is ran along the length of the wall cap 100.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A system comprising:

a wall cap having a length, the wall cap having an upper cavity and a lower cavity, the wall cap having a gap that provides access to the upper cavity and a lower opening that provides access to the lower cavity;

a wall, a portion of the wall positioned within the lower cavity of the wall cap, the wall cap being connected to the wall;

a net, a portion of the net being positioned within the upper cavity of the wall cap;

a rod positioned within the upper cavity of the wall cap, wherein the rod is intertwined through the portion of the net positioned within the upper cavity of the wall cap; and a cable, wherein the cable is wrapped around the rod along the length of the wall cap.

2. The system of claim 1, wherein the rod has an outer diameter that is larger than a distance of the gap that provides access to the upper cavity.

3. The system of claim 2, wherein the cable is positioned through a first plurality of apertures and second plurality of apertures in the wall cap, the first and second plurality of apertures being positioned through the wall cap axially above the rod.

4. The system of claim 3, wherein the cable is positioned through a third plurality of apertures and a fourth plurality of apertures in the wall cap, the third and fourth plurality of apertures being positioned through the wall cap axially below the rod.

5. The system of claim 4, wherein the cable is positioned through a fifth plurality of apertures through the wall, the fifth plurality of apertures being axially aligned with both the third and fourth plurality of apertures through the wall cap.

6. The system of claim 5, further comprising a first obstruction located at a first end of the cable, wherein the first obstruction prevents the first end of the cable from passing through the first, second, third, fourth, or fifth plurality of apertures.

7. The system of claim 6, further comprising a second obstruction located at a second end of the cable, wherein the second obstruction prevents the second end of the cable from passing through the first, second, third, fourth, or fifth plurality of apertures.

8. The system of claim 7, wherein the first and second obstructions comprise a clamp.

9. The system of claim 8, the wall cap further comprising two internal shoulders within the lower cavity, wherein an upper end of the wall is positioned adjacent to the two internal shoulders.

* * * * *